US005841332A

United States Patent [19]

Hino

[11] Patent Number: 5,841,332

[45] Date of Patent: Nov. 24, 1998

[54] DIELECTRIC FILTER AND METHOD OF ADJUSTING CENTRAL FREQUENCY OF THE SAME

[75] Inventor: Seigo Hino, Nagoya, Japan

[73] Assignee: NGK Spark Plug Co., Ltd., Aichi-Ken, Japan

[21] Appl. No.: 751,621

[22] Filed: Nov. 18, 1996

[30] Foreign Application Priority Data

Nov. 16, 1995 [JP] Japan ..... 7-298638
Nov. 16, 1995 [JP] Japan ..... 7-298640

[51] Int. Cl.[6] ..... H01P 1/205

[52] U.S. Cl. ..... 333/207; 333/203

[58] Field of Search ..... 333/202, 206, 333/207, 222, 223

[56] References Cited

U.S. PATENT DOCUMENTS

| | | | |
|---|---|---|---|
| 4,431,977 | 2/1984 | Sokola et al. | 333/206 |
| 4,523,162 | 6/1985 | Johnson | 333/203 |
| 5,321,374 | 6/1994 | Uwano | 333/207 X |
| 5,489,882 | 2/1996 | Ueno | 333/206 |
| 5,528,207 | 6/1996 | Ito | 333/206 |
| 5,629,656 | 5/1997 | Tada et al. | 333/206 |

FOREIGN PATENT DOCUMENTS

| | | | |
|---|---|---|---|
| 0 520 641 A1 | 12/1992 | European Pat. Off. . | |
| 0 635 897 A1 | 1/1995 | European Pat. Off. . | |
| 0 645 836 A1 | 3/1995 | European Pat. Off. . | |
| 60-114004 | 6/1985 | Japan . | |
| 61-062203 | 3/1986 | Japan . | |
| 61-64706 | 5/1986 | Japan . | |
| 3-6102 | 1/1991 | Japan . | |
| 3-40962 | 6/1991 | Japan . | |
| 3208401 | 9/1991 | Japan . | |
| 5-121905 | 5/1993 | Japan | 333/206 |
| 7-245505 | 9/1995 | Japan | 333/206 |
| 7-254807 | 10/1995 | Japan . | |
| 62-181005 | 11/1997 | Japan . | |

OTHER PUBLICATIONS

Patent Abstracts of Japan, vol. 95, No. 9, Oct. 1995 & JP 07142908A (Testuya), Jun. 2, 1995.

*Primary Examiner*—Seungsook Ham
*Attorney, Agent, or Firm*—Larson & Taylor

[57] ABSTRACT

A dielectric filter comprises transmission paths each of which is coupled to an associated input/output conductor provided in a dielectric ceramic block, and may be operated as capacitance means or inductance means, in which an intended center frequency can be obtained by suitably setting the lengths of the transmission paths without changing the length of each resonance conductor.

A method of adjusting the center frequency of a dielectric filter in which the center frequency of the dielectric filter is adjusted to a desired value by changing the length of each transmission path located on the top surface having a relatively wide area of the dielectric ceramic block, which may behave as capacitance means or inductance means, and the adjusting operation becomes easy and production costs can be reduced.

5 Claims, 3 Drawing Sheets

DIELECTRIC FILTER AND METHOD OF ADJUSTING CENTRAL FREQUENCY OF THE SAME

BACKGROUND OF THE INVENTION

1. Field of the Invention

This invention relates to a dielectric filter for use in a mobile radio unit such as a portable telephone or the like and to a method of adjusting the center frequency of the same.

2. Prior Art

There have been proposed and known various types of a dielectric filter in which a dielectric ceramic block of a rectangular parallelpiped shape is provided with a plurality of through holes extending from one end surface to the other opposite end surface of the dielectric ceramic block in parallel to one another, are formed in the dielectric ceramic block, each of the through holes has an interior surface formed with an inner conductive film for providing a resonance conductor, one end of each resonance conductor is connected to an outer conductor formed on an outer peripheral surface of the dielectric ceramic block to be made a short-circuit end, and the other end of the resonance conductor is separated from the outer conductor to make an open-circuit end (refer to Japanese Patent Kokai No. 60-114004, Japanese U.M. Kokai Nos. 62-181005 and 61-64706, Japanese Patent Publication No. 3-40962 and Japanese Patent Kokai No. 3-6102).

In such a dielectric filter the size of the resonance conductor or the like is preset to achieve a desired value of the center frequency thereof. However, the resonance frequency needs to be adjusted to a desired value because of variations of dimension in the dielectric ceramic block and capacity fluctuations and the like after assembly and surface mounting of the dielectric filter. Therefore, in the prior art, an open-circuit end of the resonance conductor located on one end surface or the other end surface having a relatively narrow surface area of the dielectric ceramic block is shaved off or the area of the open-circuit is extended by adding a conductor to change the length of the resonator in order to adjust the resonance frequency. Since the adjusting operation for the open-circuit end of each of the resonance conductors is carried out on the surface having a relatively narrow surface area of the dielectric ceramic block, it is very difficult.

When a dielectric material to be used and a desired resonance frequency are determined, the length of the resonator is determined naturally. Since the length of the resonator cannot be reduced though the thickness of the dielectric filter can be reduced structurally, there is limitation to the size reduction of the filter.

Further, since the dielectric filter of the above mentioned type is required to be available in various center frequencies, filter elements having different resonance lengths for each center frequency must be prepared for the production of dielectric filters, thereby making it impossible to standardize the filter elements and increasing production costs. As the resonance length varies for each center frequency in connection with this, dielectric filters are different in outer size, thereby making it difficult to achieve a relatively wide-band center frequency with the same outer size.

SUMMARY OF THE INVENTION

It is, therefore, an object of the present invention to solve the above problems and to provide a dielectric filter capable of standardizing the filter elements and adjusting the center frequency with ease and a method of adjusting the center frequency of the same.

According to a first aspect of the present invention, there is provided a dielectric filter in which a dielectric ceramic block of a rectangular parallelpiped shape includes at least two through holes extending in parallel to each other from one end surface to the other end surface opposite to said one end surface of the dielectric ceramic block, each of the through holes has an interior surface provided with an inner conductive film for forming a resonance conductor, and each of the resonance conductors has one end connected to an outer conductor formed on outer surfaces of the dielectric ceramic block to be made a short-circuit end and the other end separated from the outer conductor to make an open-circuit end, wherein the filter comprises auxiliary through holes extending from positions close to the short-circuit ends of first and last outermost resonance conductors to both lateral side surfaces of the dielectric ceramic block in directions perpendicular to the direction of arranging the above through holes, input/output conductors comprising inner conductive films provided on the interior surfaces of the auxiliary through holes, and transmission paths each having a top end open-circuited and extending from the respective input/output conductors to the top surface of the dielectric ceramic block, both side portions and top end portion being separated from the outer conductor therearound.

In the dielectric filter according to the first aspect of the present invention, it is appreciated that the transmission paths can behave as an capacitance equivalently. Therefore, the center frequency of the dielectric filter can be adjusted to a desired value by suitably setting the lengths of the transmission paths without changing the lengths of the resonance conductors, whereby the filter elements can be standardized.

According to a second aspect of the present invention, there is provided a dielectric filter in which a dielectric ceramic block of a rectangular parallelpiped shape includes at least two through holes extending in parallel to each other from one end surface to the other end surface opposite to said one end surface of the dielectric ceramic block, each of the through holes has an interior surface provided with an inner conductive film for forming a resonance conductor, and each of the resonance conductors has one end connected to an outer conductor formed on outer surfaces of the dielectric ceramic block to be made a short-circuit end and the other end separated from the outer conductor to make an open-circuit end, wherein the filter comprises auxiliary through holes extending from positions close to the short-circuit ends of first and last outermost resonance conductors to both lateral side surfaces of the dielectric ceramic block in directions perpendicular to the direction of arranging the above through holes, input/output conductors comprising inner conductive films provided on the interior surfaces of the auxiliary through holes, and transmission paths each having a top end short-circuited and extending from the respective input/output conductors to the top surface of the dielectric ceramic block, both side portions thereof being separated from the outer conductor therearound and top end portions thereof being connected to the outer conductor.

In the dielectric filter according to the second aspect of the present invention, the transmission paths can be considered to behave as an inductance equivalently.

With the dielectric filters according to the first and second aspects of the present invention, therefore, the center frequency of the dielectric filter can be adjusted to a desired value by suitably setting the lengths of the transmission paths without changing the lengths of the resonance conductors, whereby the filter elements can be standardized.

According to a third aspect of the present invention, there is provided a method of adjusting a center frequency of a dielectric filter comprising a dielectric ceramic block of a rectangular parallelpiped shape, at least two through holes extending in parallel to each other from one end surface to the other end surface opposite to said one end surface of the dielectric ceramic block, each of the through holes having an interior surface provided with an inner conductive film for forming a resonance conductor, each of the resonance conductors having one end connected to an outer conductor formed on outer surfaces of the dielectric ceramic block to be made a short-circuit end and the other end separated from the outer conductor to make an open-circuit end, auxiliary through holes extending from positions close to the short-circuit ends of the first and last outermost resonance conductors to both lateral side surfaces of said dielectric ceramic block in directions perpendicular to the direction of axes of said through holes, and input/output conductors including inner conductive films provided on the interior surfaces of said auxiliary through holes, wherein the method comprises the steps of forming transmission paths each having a top end open-circuited which extend from the respective input/output conductors to the top surface of the dielectric ceramic block, and have both side portions and top end portions separated from the outer conductor therearound, so as to have a length slightly longer than a length equivalent to a desired center frequency, and shaving off or removing the open-circuited top end portions of the transmission paths located on the top surface of the dielectric ceramic block so as to adjust the center frequency of the dielectric filter to a desired value.

In the method according to the third aspect of the present invention, the center frequency of the dielectric filter is adjusted to a desired value by shaving off part of the open-circuited top end portions of the transmission paths located on the top surface having a relatively wide area of the dielectric ceramic block to reduce the length of the transmission paths. In this connection, since the transmission paths can be considered as a capacitance equivalently as described above, the center frequency of the dielectric filter can be increased by shaving off or removing part of the open-circuited top end portions of the transmission paths to reduce the lengths of the transmission paths.

According to a fourth aspect of the present invention, there is provided a method of adjusting a center frequency of a dielectric filter comprising a dielectric ceramic block of a rectangular parallelpiped shape, at least two through holes extending in parallel to each other from one end surface to the other end surface opposite to said one end surface of the dielectric ceramic block, each of the through holes having an interior surface provided with an inner conductive film for forming a resonance conductor, each of the resonance conductors having one end connected to an outer conductor formed on outer surfaces of the dielectric ceramic block to be made a short-circuit end and the other end separated from the outer conductor to make an open-circuit end, auxiliary through holes extending from positions close to the short-circuit ends of the first and last outermost resonance conductors to both lateral side surfaces of said dielectric ceramic block in directions perpendicular to the direction of axes of said through holes, and input/output conductors including inner conductive films provided on the interior surfaces of said auxiliary through holes, wherein the method comprises the steps of:

forming transmission paths which extend from the respective input/output conductors to the top surface of the dielectric ceramic block and have both side portions separated from the outer conductor therearound by separating regions and top end portions connected to the outer conductor, so as to have a length slightly shorter than a length equivalent to a desired center frequency; and extending the transmission paths by extending said separating regions along both sides of the respective transmission paths located on the top surface of the dielectric ceramic block so as to adjust the center frequency of the dielectric filter to a desired value.

In accordance with the method of the fourth aspect of the present invention, the center frequency of the dielectric filter is adjusted to a desired value by shaving off or removing part of separating portions on both sides of the transmission paths located on the top surface having a relatively wide area of the dielectric ceramic block to extend the transmission paths. Since the transmission paths can be considered as an inductance equivalently as described above, the center frequency of the dielectric filter can be lowered by shaving off or removing part of the separating portions on both sides of the transmission paths to extend the lengths of the transmission paths.

In this way, according to the center frequency adjusting method of the present invention the adjusting operation becomes easy and production costs can be reduced.

BRIEF DESCRIPTION OF THE DRAWINGS

These and other objects and advantages of the present invention will become apparent from the following description with reference to the accompanying drawings, wherein.

DESCRIPTION OF THE PREFERRED EMBODIMENTS

Preferred embodiments of the present invention will now be described with reference to the accompanying drawings.

Figure 1:
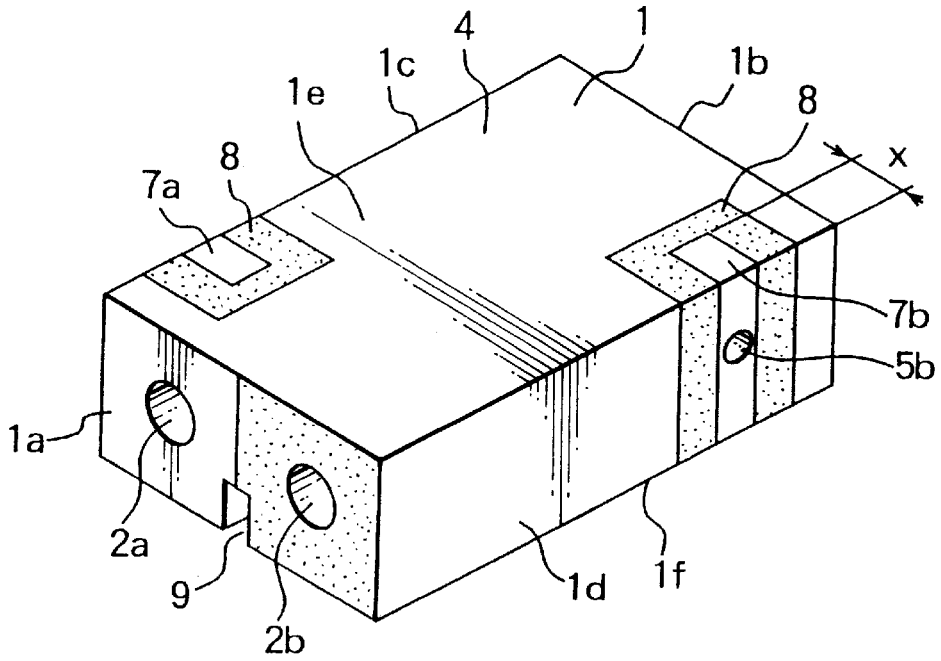
FIG. 1 is a schematic perspective view of a dielectric filter according to an embodiment of the present invention.
Figure 2:
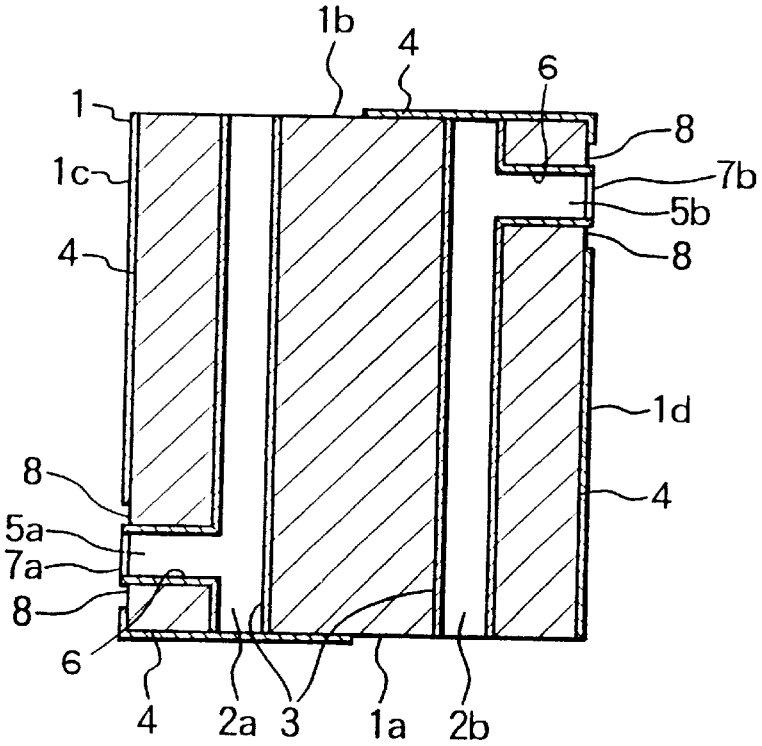
FIG. 2 is a schematic horizontal sectional view along a plane including axial lines of resonance through holes of the dielectric filter of FIG. 1.

FIGS. 1 and 2 show a dielectric filter according to an embodiment of the present invention which comprises a dielectric ceramic block 1 in the form of a single rectangular parallelpiped made from a titanium oxide-based dielectric ceramic material. Two through holes 2*a* and 2*b* are formed in this dielectric ceramic block 1 so that they extend from a front end surface 1*a* to a rear end surface 1*b* in parallel with each other. An inner conductive film 3 is formed on the interior surface of each of the through holes 2*a* and 2*b* to form a resonance conductor. An outer conductor 4 is formed on substantially all the outer surfaces of the dielectric ceramic block 1 except half portions of the front end surface 1*a* and the rear end surface 1*b* of the dielectric ceramic block 1 and functions as an earth electrode. One end portion of the inner conductive film 3 formed in the interior surface of one of the through holes 2*a* is open to the front end surface 1*a* of the dielectric ceramic block 1 and is connected to the outer conductor 4 on the front end surface 1*a* so as to make a short-circuit end, and the other end portion which is open to the rear end surface 1*b* is separated from the outer conductor 4 to be made a open-circuit end. Similarly, the inner conductive film 3 formed in the interior surface of one of the through holes 2*b* has one end portion which is open to the front end surface 1*a* of the dielectric ceramic block 1 and is separated from the outer conductor 4 on the front end surface 1*a* so as to make an open-circuit end and the other end portion which is open to the rear end surface 1*b* and is connected to the outer conductor 4 to be made a short-circuit end.

At positions close to the short-circuit ends of the respective resonance conductors are provided auxiliary through holes 5*a* and 5*b* which extend from the through holes 2*a* and 2*b* of the resonance conductors to the side surfaces 1*c* and 1*d* of the dielectric ceramic block 1 in directions perpendicular to the directions of arranging the through holes 2*a* and 2*b*. An inner conductive film 6 is formed on the interior surface of each of the auxiliary through holes 5*a* and 5*b* to form an input/output conductor. Inner end portions of these inner conductive films, namely, input/output conductors 6, are connected to the inner conductive films, namely, resonance conductors 3 of the through holes 2*a* and 2*b*, and outer end portions thereof are connected to transmission paths 7*a* and 7*b* which are provided to be extended from the side surfaces 1*c* and 1*d* surrounding the outer end portions to the top surface 1*e* of the dielectric ceramic block 1 as shown in FIG. 1. Each of these transmission paths 7*a* and 7*b* is defined by a separating portion 8 which can be formed by removing partially the outer conductor 4 formed on the side surfaces 1*c* and 1*d* and top surface 1*e* of the dielectric ceramic block 1. Each transmission path 7*a* and 7*b* has lateral side portions and a top end portion which are separated from the outer conductor 4 on the outer surfaces of the dielectric ceramic block 1 by the separating portion 8 so as to form an open-circuit top end. These transmission paths 7*a* and 7*b* each having a top end open-circuited function as a capacitance equivalently.

In FIG. 1, portions shown by many dots represent portions of the surfaces of the dielectric ceramic block 1 devoid of the conductor. Reference numeral 9 represents an adjusting groove for an inter-stage coupling which is provided on the under surface 1*f* of the dielectric ceramic block 1 at an intermediate position between a pair of the through holes 2*a* and 2*b* in the same direction of the through holes.

Figure 3:
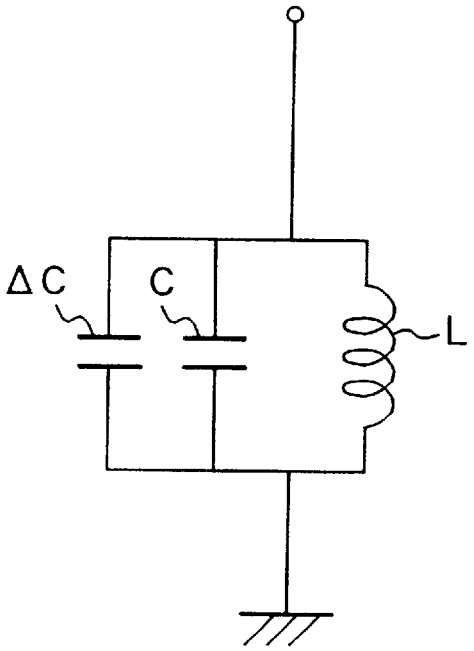
FIG. 3 is a diagram of an equivalent circuit of a unit resonator of the dielectric filter of FIG. 1.

Therefore, the equivalent circuit of a single resonator in the dielectric filter arranged above can be expressed as shown in FIG. 3. L is an equivalent inductance of the resonator, C is an equivalent capacitance of the resonator and ΔC is an equivalent capacitance of the transmission path.

The resonance frequency $f_o$ of a dielectric filter having no transmission paths is represented by the following equation.

$$f_o = \tfrac{1}{2}\pi(LC)^{1/2}$$

Therefore, when the filter is provided with the transmission paths each having an open-circuited top end, the resonance frequency $f_o'$ can be represented by the following equation.

$$f_o' = \tfrac{1}{2}\pi[L(C+\Delta C)]^{1/2} < f_o$$

Therefore, the resonance frequency obtained by the filter provided with the transmission paths whose top ends are open-circuited is lower than that obtained by the filter having no transmission paths. Then, the resonance frequency $f_o'$ can be increased by reducing ΔC or the length of each transmission path whose top end is open-circuited. In other words, a filter having a predetermined resonance frequency $f_o'$ can be provided by suitably selecting the length x of each transmission path whose top end is open-circuited.

In the illustrated dielectric filter in which the resonance through holes 2*a* and 2*b* each having a diameter of 0.8 mm are formed at an interval of 2.9 mm in the dielectric ceramic block 1 of a parallelpiped shape 9.2 mm long and 5.9 mm wide made from the ceramic material having a dielectric constant of 81 and a non load Q factor (Qu) of 1500 (at 2.7 GHz) and the input/output through holes 5*a* and 5*b* each having a diameter of 0.5 mm are formed at positions 1.64 mm apart from short-circuit ends on the front and rear end surfaces of the dielectric ceramic block 1, as shown in FIG. 1, the following measurement results show how the resonance frequency is changed when the width of each of the transmission paths 7*a* and 7*b* with open-circuit top ends and the width of the separating portion or space region 8 are set to 0.8 mm and the length x of each of the transmission paths 7*a* and 7*b* is set to various values.

| Length × of Transmission path (mm) | Resonance frequency (MHz) |
|---|---|
| 1.5 | 902.5 |
| 1.0 | 910.5 |
| 0.5 | 915.5 |
| 0 | 920.5 |

As will be understood from the above measurement results, the longer the transmission paths 7*a* and 7*b* the lower the resonance frequency becomes.

Therefore, the transmission paths 7*a* and 7*b* each having a length x slightly longer than a length equivalent to an intended resonance frequency are initially provided and then are shortened by shaving off or removing the open-circuit end of each of the transmission paths 7*a* and 7*b* on the top surface 1*e* having a relatively large surface area of the dielectric ceramic block 1 before or after the dielectric filter is mounted on a printed circuit board not shown. Thus the resonance frequency of the filter can be adjusted to a desired value with ease.

Figure 4:
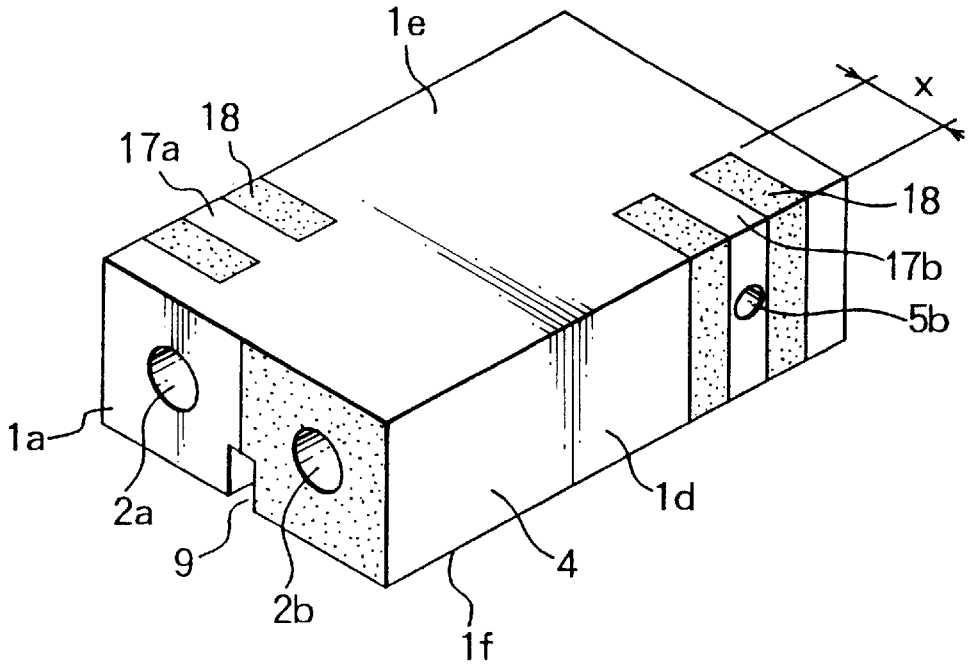
FIG. 4 is a schematic perspective view of a dielectric filter according to another embodiment of the present invention.

Referring now to FIG. 4, there is illustrated a dielectric filter according to another embodiment of the present invention, where those components that are identical or similar to those of FIGS. 1 and 2 are denoted by the same reference numerals, respectively.

The dielectric filter illustrated in FIG. 4 is substantially identical to that illustrated in FIGS. 1 and 2 excepting the arrangement of transmission paths.

Figure 5:
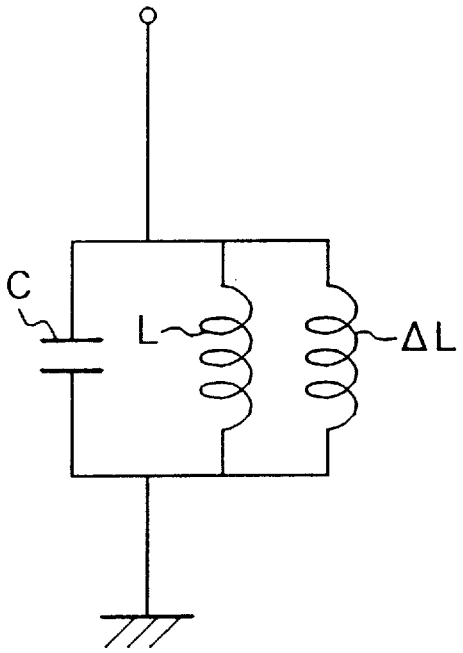
FIG. 5 is a diagram of an equivalent circuit of a unit resonator of the dielectric filter of FIG. 4.

In the dielectric filter illustrated in FIG. 4, each of the transmission paths 17*a* and 17*b* is arranged so that one end or top end portion is connected to the outer conductor 4 on the top surface 1*e* of the dielectric ceramic block 1 and both lateral edge portions are separated from the outer conductor 4 by two separating portions 18 which can be formed by removing partially the outer conductor 4 formed on both sides thereof from the side surfaces 1*c*, 1*d* of the dielectric ceramic block 1 to the top surface 1*e* of the dielectric ceramic block 1. Thus, the one end portion of each of the transmission paths 17*a* and 17*b* is intended to operate as a short-circuit end. It is, therefore, appreciated that the transmission paths 17*a* and 17*b* function as an inductance equivalently. FIG. 5 shows the equivalent circuit of a single resonator in the dielectric filter constituted above, in which L is an equivalent inductance of the resonator, C is an equivalent capacity of the resonator and ΔL is an equivalent inductance of the transmission path with short-circuit end.

The resonance frequency $f_o$ of a dielectric filter having no transmission paths is represented by the following equation.

$$f_o=\frac{1}{2\pi}(LC)^{1/2}$$

Therefore, when the filter is provided with the transmission paths each having a short-circuited top end, the resonance frequency $f_o'$ can be represented by the following equation.

$$f_o'=\frac{1}{2\pi}[LC(\Delta L/(L+\Delta L))]^{1/2}>f_o$$

Therefore, the resonance frequency obtained by the filter provided with the transmission paths whose top ends are short-circuited is higher than that obtained by the filter having no transmission paths. Then, the resonance frequency $f_o'$ can be decreased by increasing ΔL or the length x of each transmission path whose top end is short-circuited. In other words, a filter having a predetermined resonance frequency $f_o'$ can be provided by suitably selecting the length x of each transmission path whose top end is short-circuited.

For the dielectric filter of FIG. 4 prepared to have the same dimensions as that above mentioned in connection to the filter of the first embodiment, the measurement results of the resonance frequency which is changed when the width of each of the transmission paths 17*a* and 17*b* and the width of the separating portion 18 are set to 0.8 mm and the length x of each of the end short-circuit transmission paths 17*a* and 17*b* is set to various values are shown below.

| Length x of Transmission path (mm) | Resonance frequency (MHz) |
|---|---|
| 0 | 902.5 |
| 0.5 | 897.0 |
| 1.0 | 892.0 |
| 1.5 | 887.5 |

As will be understood from the above measurement results, the longer the transmission paths the lower the resonance frequency becomes.

Therefore, the transmission paths 17*a* and 17*b* having a length x slightly shorter than a length equivalent to an intended resonance frequency are initially provided and then are extended by shaving off or removing the end portions of the separating portions 18 on both sides of each transmission path on the top surface 1*e* having a relatively large surface area of the dielectric ceramic block 1 before or after the dielectric filter is mounted on the printed circuit board not shown. Thus the resonance frequency can be adjusted to a desired value with ease.

In the illustrated embodiments, the dielectric filter is of an inter-digital structure that short-circuit ends and open-circuit ends of the resonator conductors are arranged alternately on opposite sides. Alternatively, the filter may be arranged as a comb-shaped structure that short-circuit ends and open-circuit ends are disposed on the same sides, respectively. The shape of the resonance conductor does not need to be circular but may be any shape at need.

Also, with the illustrated embodiments, the interstage coupling adjusting groove 9 is formed only in the under surface if of the dielectric ceramic block 1. However, it may be formed in the top surface 1*e* similarly. Alternatively, the inter-stage coupling adjusting grooves may not be formed.

Although a filter having a pair of resonance conductors has been illustrated in the above embodiments, the present invention can be applied to a filter comprising three or more resonance conductors.

As described on the foregoing, since the dielectric filter according to the present invention has the transmission paths coupled to the input/output conductors which may be operated as capacitance means or inductance means, the present invention can provide a filter having a desired center frequency by suitably setting the lengths of the transmission paths without changing the lengths of the resonance conductors, whereby the filter elements can be standardized and production costs can be reduced.

In the method of adjusting the center frequency of a dielectric filter according to the present invention, since the center frequency of the dielectric filter is adjusted to a desired value by changing the length of each transmission path located on the top surface having a relatively wide area of the dielectric ceramic block, which may behave as capacitance means or inductance means, the adjusting operation becomes easy and production costs can be reduced.

We claim:

1. A dielectric filter comprising a dielectric ceramic block, of a rectangular parallelpiped shape, having a top surface and including at least two through holes extending in parallel to each other from one end surface of the dielectric ceramic block, to the other end surface opposite to said one end surface, each of said through holes having an interior surface provided with an inner conductive film forming a resonance conductor, and each of said resonance conductors having one end connected to an outer conductor formed on outer surfaces of said dielectric ceramic block to make a short-circuit end and the other end separated from said outer conductor to make an open-circuit end, said dielectric ceramic block having a bottom surface, said through holes having longitudinal axes and the filter further comprising:

an auxiliary through holes extending from positions close to short-circuit ends of the first and last outermost resonance conductors to respective opposed lateral side surfaces of said dielectric ceramic block in directions perpendicular to the direction of the longitudinal axes of said through holes;

input/output conductors comprising conductive films provided on the interior surfaces of said auxiliary through holes and connected to said first and last outermost resonance; and transmission paths each extending from a bottom edge of said respective lateral side surfaces to the top surface of said dielectric ceramic block and connected to said respective input/output conductors to obtain a desired center frequency for the filter, said transmission paths each having side portions separated from the outer conductor therearound.

2. A dielectric filter as claimed in claim 1, wherein said each transmission path has an open-circuited top end separated from the outer conductor and forms a capacitance means.

3. A dielectric filter as claimed in claim 1, wherein said each transmission path has a short-circuited top end connected to the outer conductor and forms an inductance means.

4. A method of adjusting the center frequency of a dielectric filter comprising a dielectric ceramic block of a rectangular parallelpiped shape and having a top surface, at least two through holes having longitudinal axes and extending in parallel to each other from one end surface of the dielectric ceramic block to the other end surface opposite to said one end surface, each of the through holes having an interior surface provided with an inner conductive film forming a resonance conductor, each of the resonance conductors having one end connected to an outer conductor formed on outer surfaces of the dielectric ceramic block to make a short-circuit end and the other end separated from the outer conductor to make an open-circuit end, auxiliary through holes extending from positions close to the short-circuit ends of the first and last outermost resonance conductors to respective opposed lateral side surfaces of said dielectric ceramic block in directions perpendicular to the direction of the axes of said through holes, and input/output conductors including conductive films provided on the interior surfaces of said auxiliary through holes and connected to said first and last outermost resonance conductors, and said dielectric ceramic block having a bottom surface, the method comprising steps of:

forming transmission paths, each having an open-circuited top end, which extend from the respective input/output conductors to the top surface of the dielectric ceramic block and which have both side portions and top end portions separated from the outer conductor therearound, so as to have a length slightly longer than a length equivalent to a desired center frequency; and removing the open-circuited top end portions of the transmission paths located on the top surface of the dielectric ceramic block so as to adjust the center frequency of the dielectric filter to a desired value.

5. A method of adjusting a center frequency of a dielectric filer comprising a dielectric ceramic block of a rectangular parallelpiped shape and having a top surface, at least two through holes having longitudinal axes and extending in parallel to each other form one end surface of the dielectric ceramic block to the other end surface opposite to said one end surface, each of the through holes having an interior surface provided with an inner conductive film forming a resonance conductor, each of the resonance conductors having one end connected to an outer conductor formed on outer surface of the dielectric ceramic block to make a short-circuit end and the other end separated form the outer conductor to make an open-circuit end, auxiliary through holes extending from positions close to the short-circuit ends of the first and last outermost resonance conductors to respective opposed lateral side surfaces of said dielectric ceramic block in directions perpendicular to the direction of the axes of said through holes, and input/output conductors including 2conductive films provided on the interior surfaces of said auxiliary through holes and connected to said first and last outermost resonance conductors, and said dielectric ceramic block having a bottom surface, the method comprising the steps of:

forming transmission paths which extend form the respective input/output conductors to the top surface of the dielectric ceramic block and have both side portions separated from the outer conductor therearound by separating regions and top end portions connected to the outer conductor, so as to have a length slightly shorter than a length equivalent to a desired center frequency; and extending the transmission paths by extending said separating regions along both sides of the respective transmission paths located on the top surface of the dielectric ceramic block so as to adjust the center frequency of the dielectric filter to a desired value.

* * * * *